US006115985A

United States Patent [19]

Wu

[11] Patent Number: 6,115,985

[45] Date of Patent: Sep. 12, 2000

[54] MULTI-COLORED SOLID WOOD COMBINATION FOR DECORATIVE/ FURNITURE PURPOSES

[76] Inventor: A Hua Wu, No.2-2, Lane 98, Sec 1, Cheng Tai Rd., Wu Ku Hsiang, Taipei Hsien, Taiwan

[21] Appl. No.: 09/295,499

[22] Filed: Apr. 21, 1999

[30] Foreign Application Priority Data

May 5, 1998 [TW] Taiwan ..... 87206926

[51] Int. Cl.[7] ..... E04C 3/30

[52] U.S. Cl. ..... 52/720.2; 52/726.3; 52/127.7

[58] Field of Search ..... 52/720.2, 664, 52/127.7, 726.3; 256/59, 65, 69, 19

[56] References Cited

U.S. PATENT DOCUMENTS

| | | | |
|---|---|---|---|
| 310,807 | 1/1885 | Ferer | 52/720.2 |
| 349,669 | 9/1886 | Strahan | 52/720.2 |
| 5,035,401 | 7/1991 | Solter | 256/19 |
| 5,572,845 | 11/1996 | DeSouza | 52/664 |

*Primary Examiner*—Christopher T. Kent
*Assistant Examiner*—Jennifer I. Thissell
*Attorney, Agent, or Firm*—Dougherty & Troxell

[57] ABSTRACT

The subject invention relates to an assembling element of multi-colored solid wood combination for decorative/ furniture purposes, particularly to a multi-colored assembling unit that is composed of solid wood of different, natural colors and grains, that can be assembled to form interior stairs, armrest, railing, a piece of furniture, or other decorative panel or display articles in various beautiful configurations, that is composed of at least two or more different solid wood materials which are respectively processed and styled to become partial sections for an assembling element, the sections are then penetrated and fastened by a joining element to configure an assembling element, so various assembling elements of different colors can be assembled to become stair steps, armrests, railings, furniture or other decorative panel (post) for interior decorative and furnishing purposes.

1 Claim, 4 Drawing Sheets

MULTI-COLORED SOLID WOOD COMBINATION FOR DECORATIVE/ FURNITURE PURPOSES

BACKGROUND OF THE INVENTION

The subject invention relates to a multi-colored solid wood combination for decorative/furniture purposes, particularly to a solid wood material for decorative or furniture or other furnishing purposes, that involves more than one color tone of solid wood in a same assembling element, demonstrating beautified colorful solid wood decorative performance, to completely replace the monotonous appearance and lack of variation in conventional solid wood material involving only one color (such as the assembling element of maple wood involving only a monotonous white color).

Solid wood is widely used by consumers for interior decoration, due to its natural color tones and natural grains, as well as its durability and value that enhance the taste and sense of quality which appeal to consumers, particularly in fashion trends of decoration such as "Japanese-style rooms", "stairs, stair steps, armrest, railing, etc. in elevated rooms", or "furniture", display articles" or other solid wood panel (post) materials for decorative purposes, consumers would often choose decorative materials made of raw wood; in current practice at the present, when solid wood materials are used for the production of a decorative or furniture item (such as a solid wood stair), only solid wood of a same single color and grain will be used, the assembling elements, such as a piece of stair step, a piece of railing, or a section of armrest, etc., regardless of whether it has been pre-processed or pre-formed, or to be manufactured at the work site, will be able to demonstrate only a same solid wood of a same color and grain, in other words, a conventional solid wood decorative article or piece of furniture will not be able to present various colors of solid wood decorative appearance, therefore, it is considered by consumers as monotonous and lacking variety in the current trend of decorative aesthetics demanding variety and fashion.

Conventional solid wood decorative articles or furniture sets are generally of made of a same kind of solid wood in a same color and grain, when the entire assembling elements are assembled to become a finished product. Though the stair steps, the railing, the armrest, etc. can be assembled to show different colors of solid wood, the results would be incongruous since the whole piece of stair step; the whole piece of railing and the whole row of armrest are made of quite different colors, lacking the sense of taste, quality and value inherent in solid wood products, it simply could not show different colors of solid wood on a same piece of stair step, a single piece of railing, or a same piece of armrest.

SUMMARY OF THE INVENTION

An assembling element of multi-colored solid wood combination for decorative/furniture purposes, particularly one that will be able to express various kinds of solid wood in different colors and grains on an assembled piece of furniture or decorative article, to configure beautiful combinations of various colors of solid wood decorative effects, so the solid wood materials will have multi-colored decorative performance, comprising of at least two or more different solid wood that are processed and styled to become an appropriate section in an assembling element, that can be joined and assembled by joining elements to configure an assembling element with various colors for stair steps, armrest, railing, a piece of furniture or decorative panel (post), while retaining the inherent properties of durability, sense of value and quality, etc. in solid wood furniture, to enable the variety of decorative articles, furniture or display items with a touch of personal style and fashion.

DETAILED DESCRIPTION OF PREFERRED EMBODIMENT

The construction of the subject invention involves the two or more kinds of different solid wood that are processed and styled respectively to become partial sections as assembling elements, which are then joined by joining elements to form assembling elements of different colors of solid wood for the assembly of stair steps, armrest, railing, furniture or other decorative panels, serving as materials of solid wood for colorful interior decoration, furniture or decorative articles, or other decorative wood panels or posts.

Figure 1:
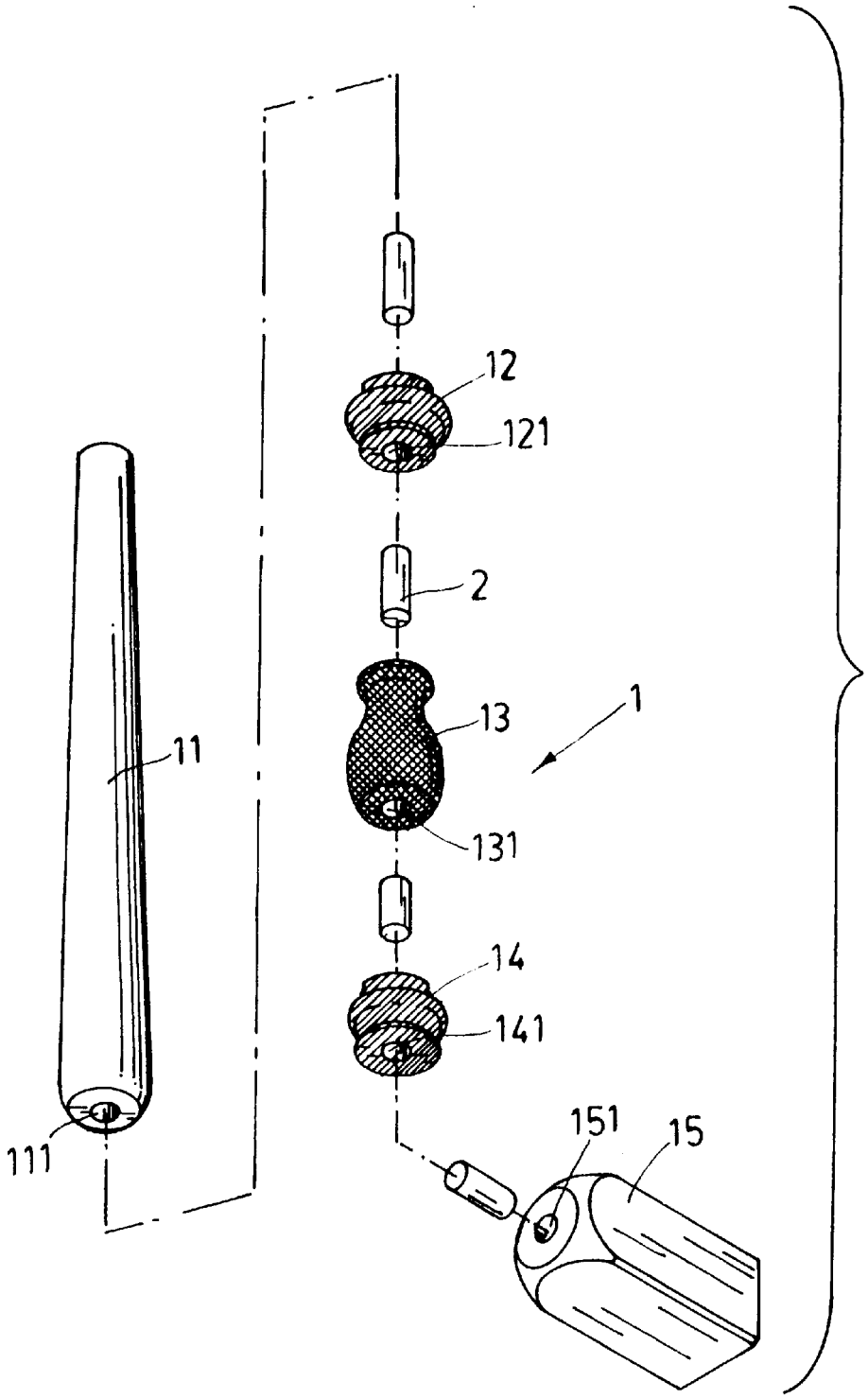
FIG. 1 is a disassembled view of an embodiment of the invention.
Figure 2:
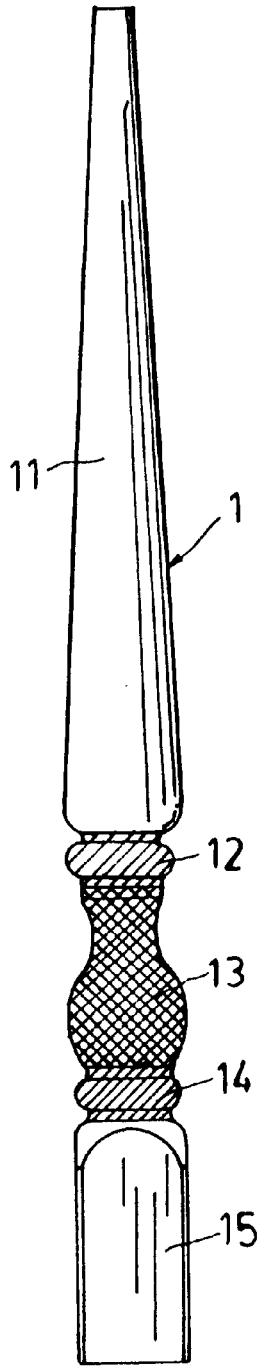
FIG. 2 is a side section view of the invention in FIG. 1.
Figure 3:
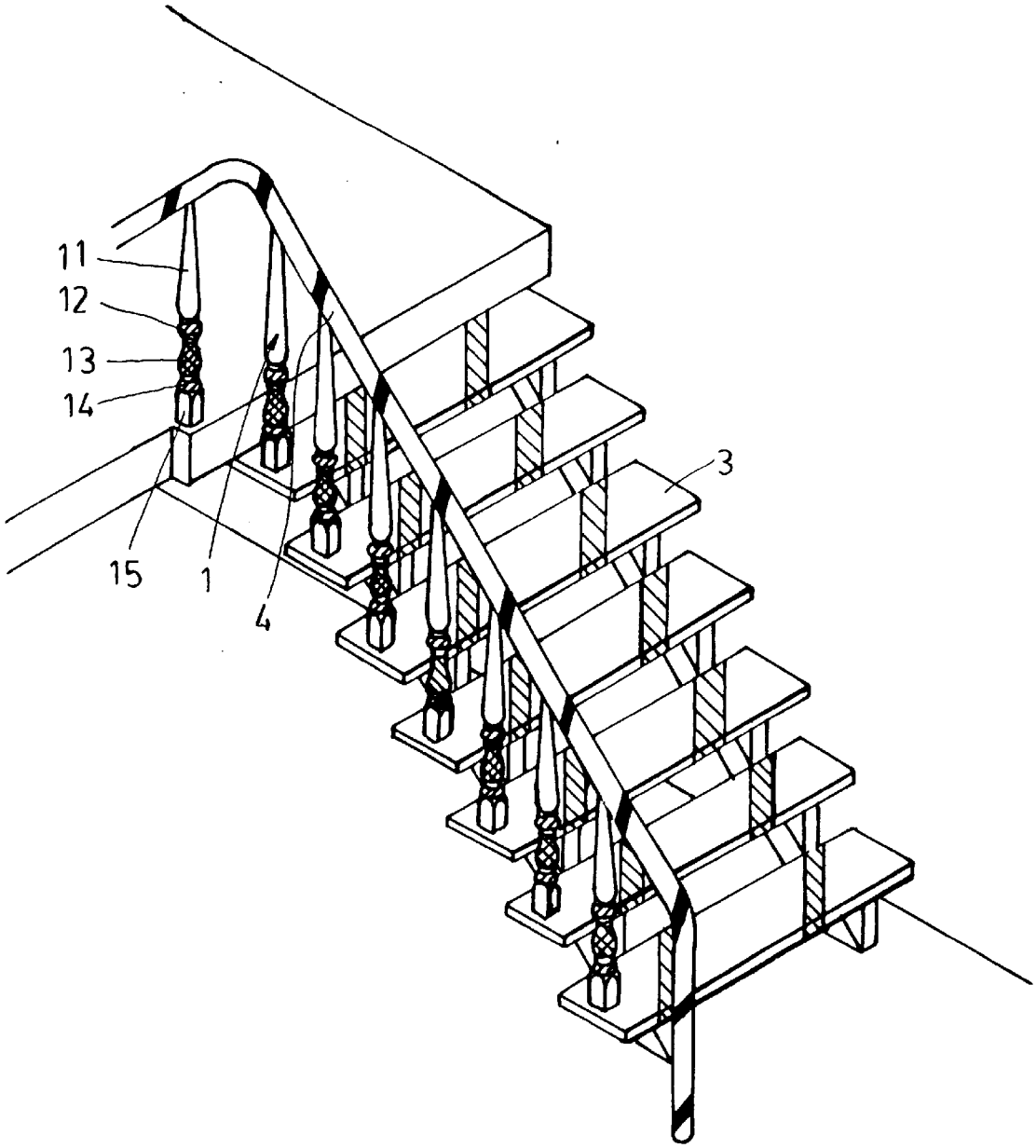
FIG. 3 is a view of embodiment of the invention in the assembly of solid wood stairs.

Please refer to FIGS. 1 and 2, which illustrate an embodiment of the subject invention when applied to a stair railing post, wherein said railing post 1 is composed of three different kinds of solid wood to become a colorful railing post 1, in the subject embodiment, said railing post 1 is an assembly of several sections 11, 12, 13, 14, 15 that are joined together, each of said sections 11, 12, 13, 14, 15 has been processed and styled in its individual configuration from selected solid wood materials to suit its position in the railing post 1, meanwhile in the subject embodiment, the first and fifth sections 11, 15 are made of solid wood of a same kind (such as, yellow solid wood of beech or ivory wood), while the second and fourth sections 12, 14 can be solid wood of maple or beech of a whiter color, and the third section 13 assembled between the second and fourth sections can be red solid wood of African redwood or Burmese Rosewood, the two ends of the sections 11, 12, 13, 14, 15 are drilled to have their respective joining holes 111, 121, 131, 141, 151 which are then penetrated by a joining element 2 to assemble and fasten all sections 11, 12, 13, 14, 15 in the railing post 1, such a joining element 2 can be made of a wood tenon of one or more appropriate lengths (as shown in FIG. 1), said tenon serving to penetrate the joining holes 111, 121, 131, 141, 151 through the ends of the sections 11, 12, 13, 14, 15, so that all the sections 11, 13, 14, 15 are tightened by the joining element 2 to compose and configure a same railing post 1 on the stairs, thus by such combination of various colors and wood grains of solid wood, the colorful railing post 1 is fitted to a background of similarly colorful solid wood combination of stair steps 3, armrest 4, etc., to accomplish the assembly of solid wood stairs (as shown in FIG. 3) in a combination of various colors of solid wood, instead of monotonous single-color appearance.

Figure 4:
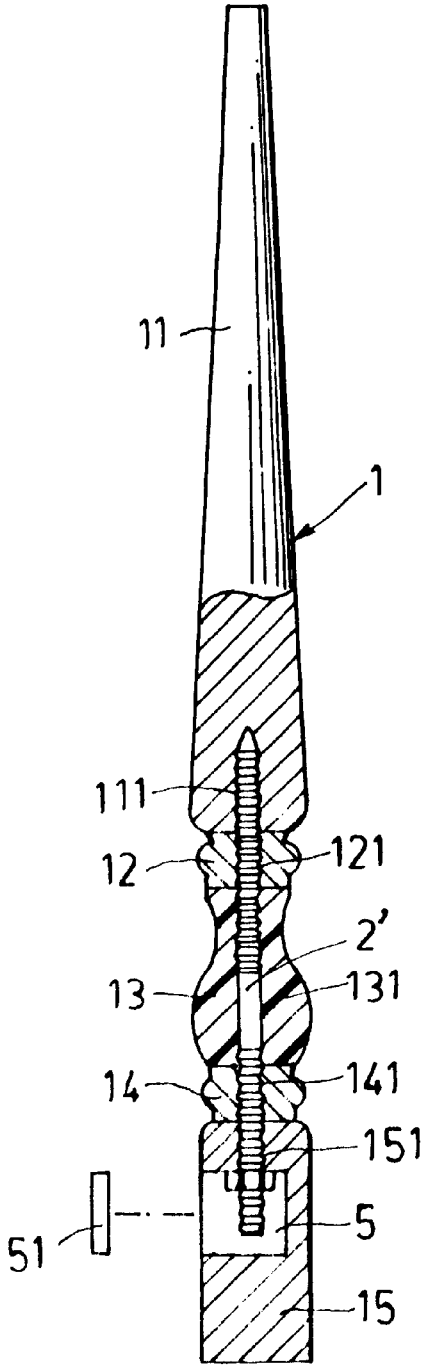
FIG. 4 is a structural view of another embodiment of the joining elements of the invention.

Said joining element 2 serving to join and fasten the sections 11, 12, 13, 14, 15 can be made of at least one screw bolt 2'(shown in FIG. 4), with its one end directly inserted into the joining holes 111, 151 of the first or fifth section 11 or 15, while the other end is inserted through the other sections 12, 13, 14, 15 (or 11), meanwhile, at the end of the section 15 or 11 corresponding to the other end of the joining element 2 is an operating compartment 5 communicating with the joining hole 151 or 111, so that a nut 21 can be fastened onto the second end of the joining element 2 to tighten it, then, a sealing block 51 is fixed to block and seal the operating compartment 5, which is then subjected to surface grinding and processing to eliminate any trace of the sealing process and enable good-looking appearance; an alternative for joining the sections will involve the use of adhesive bond that is applied onto the adjoining surfaces on the ends of the sections 11, 12, 13, 14, 15, so that the neighboring sections 11, 12, 13, 14, 15 can be glued together to compose an assembling element.

Figure 5:
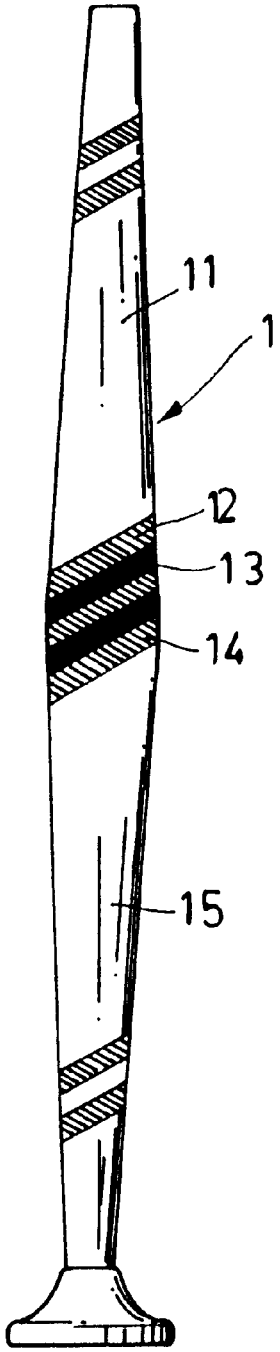
FIG. 5 is a view of the joining element of the invention assembled with another sections.

Please refer to FIG. 5, which is a view of the joining element of the invention assembled with another sections. In this embodiment, the railing post 1 is the subject of description. The sections 11, 12, 13, 14, 15 used to compose the assembling element and the railing post 1 can be designed and processed into any possible shapes and configurations, and their assembling ends can also be formed to demonstrate various colors, styles, any angles of inclination, orientation or any combination of quantities or locations.

The above description of a preferred embodiment shall not be based to restrict or limit the subject invention, in other words, the subject invention of multi-colored solid wood combination can be applied to the assembly of furniture, decorative items or other decorative panels (posts), therefore, all similar applications, variations or modifications deriving from the inventive step of the subject invention should be included in the scope of the subject claims.

What is claimed is:

1. A multi-colored wood assembly for decorative purposes comprising three wood elements of different colors and grains defining complementary shapes, said elements being coaxially aligned and juxtapositioned to form a longitudinally extending assembly with two end elements and a middle element, said end and middle elements defining a longitudinally extending bore passing through said middle element and into each of the two end elements, a longitudinally extending screw bolt having a screw portion at one end thereof and a bolt head portion at its opposite end extending through said middle element with the screw portion threadedly received in a first of said two end elements and with the bolt head extending into said other of said end elements, and said other of said end elements defining an operating compartment around said bolt head portion for access to said bolt head portion of said screw bolt, a nut threadedly received on said bolt heat portion and tightened to pull said juxtapositioned axially aligned elements tightly together, and a wood sealing block fitting over said operating compartment and adhesively sealing said operating compartment to form a smooth outer surface with an attractive appearance of a solid wood assembly.

* * * * *